US010697418B2

(12) United States Patent
Miyashita

(10) Patent No.: US 10,697,418 B2
(45) Date of Patent: Jun. 30, 2020

(54) HYBRID VEHICLE

(71) Applicant: TOYOTA JIDOSHA KABUSHIKI KAISHA, Toyota-shi, Aichi-ken (JP)

(72) Inventor: Shigeki Miyashita, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 22 days.

(21) Appl. No.: 16/244,437

(22) Filed: Jan. 10, 2019

(65) Prior Publication Data

US 2019/0277240 A1 Sep. 12, 2019

(30) Foreign Application Priority Data

Mar. 7, 2018 (JP) ..... 2018-040786

(51) Int. Cl.

| | |
|---|---|
| ***F02D 1/00*** | (2006.01) |
| ***F02N 19/00*** | (2010.01) |
| ***F02B 21/02*** | (2006.01) |
| ***F02D 13/02*** | (2006.01) |
| ***F02N 9/04*** | (2006.01) |
| *F02B 23/10* | (2006.01) |
| *F02D 29/02* | (2006.01) |
| *F02D 35/02* | (2006.01) |

(52) U.S. Cl.

CPC ..... *F02N 19/004* (2013.01); *F02B 21/02* (2013.01); *F02D 13/0234* (2013.01); *F02D 13/0276* (2013.01); *F02N 9/04* (2013.01); *F02B 23/101* (2013.01); *F02D 29/02* (2013.01); *F02D 35/023* (2013.01); *F02N 2200/021* (2013.01); *F02N 2200/022* (2013.01)

(58) Field of Classification Search

CPC .... F02D 31/001; F02D 31/002; F02D 31/006; F02D 31/008; F02D 31/003; F01L 13/065; F01L 13/08

USPC ..... 123/90.1, 90.39, 319, 320, 345–348

See application file for complete search history.

(56) References Cited

U.S. PATENT DOCUMENTS

| | | | | |
|---|---|---|---|---|
| 2012/0304945 | A1* | 12/2012 | Nakamura | F02D 13/0211 123/90.17 |
| 2013/0030624 | A1* | 1/2013 | Suyama | B60K 6/387 701/22 |
| 2015/0134171 | A1* | 5/2015 | Asami | B60W 20/10 701/22 |

(Continued)

FOREIGN PATENT DOCUMENTS

JP 2014-047695 A 3/2014

*Primary Examiner* — John Kwon
(74) *Attorney, Agent, or Firm* — Oliff PLC

(57) ABSTRACT

Provided is a hybrid vehicle that includes a power train including an internal combustion engine equipped with a plurality of cylinders and a drive motor unit. The drive motor unit includes an electric motor coupled to the internal combustion engine without a clutch. The internal combustion engine includes one or more decompression devices that are each installed for a subset of one or more cylinders and that operate to release compression pressure in the subset of one or more cylinders in at least one of the course of an engine stop and course of an engine start-up in which combustion is not performed. The subset of one or more cylinders are selected such that, when the one or more decompression devices are operating, compression is not produced sequentially in cylinders that are adjacent to each other in terms of the firing order.

3 Claims, 9 Drawing Sheets

(56) References Cited

U.S. PATENT DOCUMENTS

| | | | | |
|---|---|---|---|---|
| 2018/0283343 | A1* | 10/2018 | Wabbals | F02D 13/0226 |
| 2019/0301419 | A1* | 10/2019 | Miyashita | F02D 41/042 |
| 2020/0072134 | A1* | 3/2020 | Hotta | F01L 1/34 |

* cited by examiner

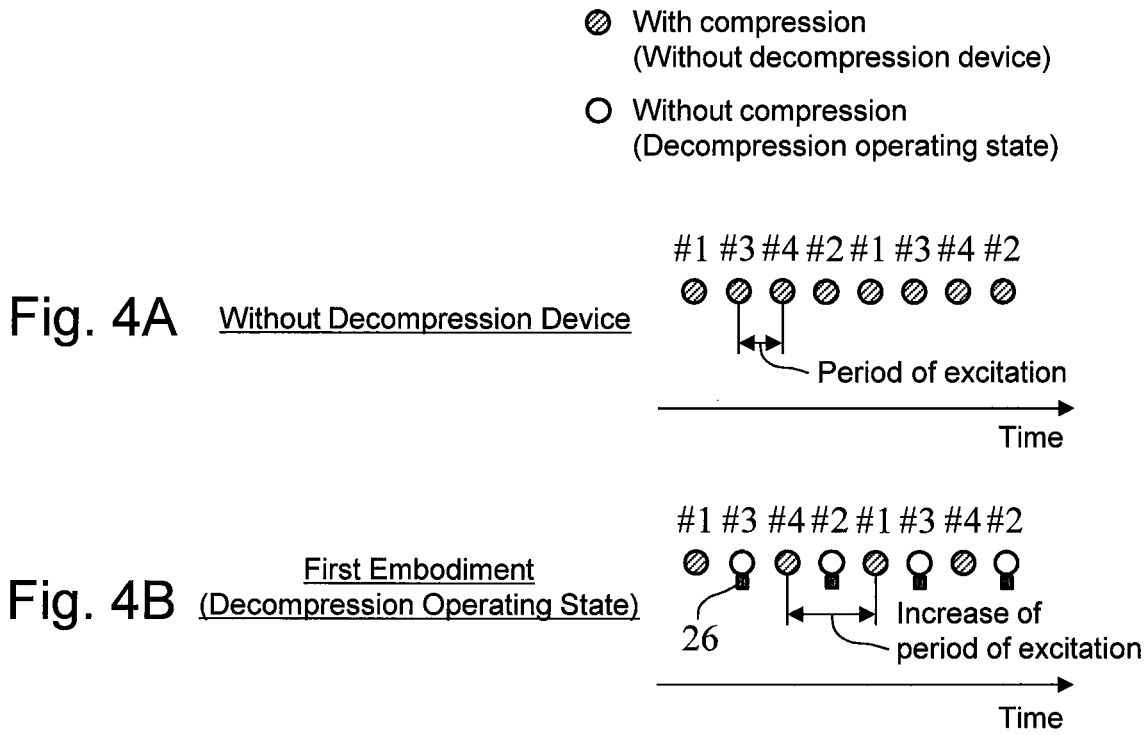
Fig. 5
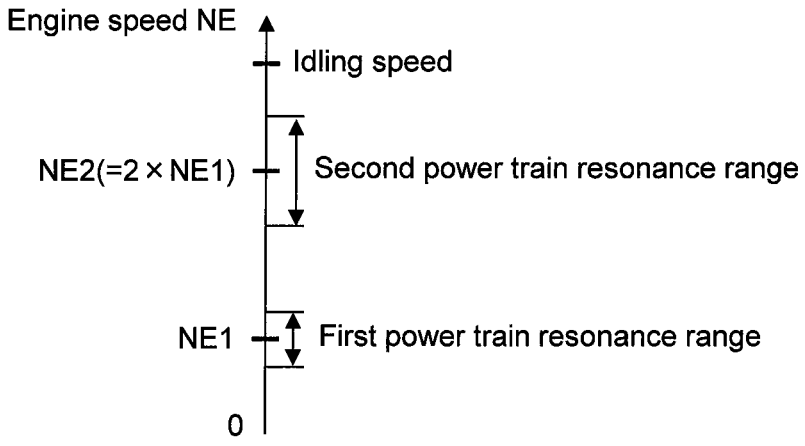

HYBRID VEHICLE

CROSS-REFERENCE TO RELATED APPLICATION

This application is based on and claims the benefit of Japanese Patent Application No. 2018-040786, filed on Mar. 7, 2018, which is incorporated by reference herein in its entirety.

BACKGROUND

Technical Field

The present disclosure relates to a hybrid vehicle and more particularly to a hybrid vehicle provided with, as well as a drive motor unit, an internal combustion engine having a decompression device for releasing compression pressure in a cylinder.

Background Art

An internal combustion engine provided with a decompression device (also called a pressure reducing device) for releasing compression pressure in a cylinder. is known. This kind of decompression device is configured to be able to select between a state in which a decompression operation to release the compression pressure in the cylinder is performed (hereunder, referred to as a "decompression operating state") and a state in which the decompression operation described above is not performed even if a crankshaft is rotating (hereunder, referred to as a "decompression stop state").

For example, JP 2014-047695 A discloses a control device for an internal combustion engine that includes the decompression device as described above. In order to reduce vibration of a vehicle body, this control device controls the decompression device such that the decompression operating state in the course of engine stop and in the course of engine start-up is selected. Moreover, an example of this decompression device is a variable valve operating device that can change the closing timing of an intake valve. The decompression operating state is achieved by retarding the closing timing of the intake valve.

SUMMARY

There is known a hybrid vehicle provided with a power train that includes an internal combustion engine having a plurality of cylinders and a drive motor unit having an electric motor coupled to the internal combustion engine without a clutch therebetween.

According to this kind of hybrid vehicle, it is effective to install a decompression device in order to reduce vibration and noise associated with resonance of the power train due to compression of the internal combustion engine (i.e. excitation force) in the course of engine stop and the course of engine start-up in which combustion is not performed.

More specifically, if the compression is continuously performed in all the cylinders, the resonance occurs at the power train in an engine speed range (hereunder, referred to as a "first power train resonance range") that centers on an engine speed value at which the period of excitation due to the compression coincides with a natural vibration period of the drive motor unit. If the decompression device is provided for each of all the cylinders, the resonance can be reduced by the use of the decompression device in this kind of first power train resonance range.

On the other hand, in the hybrid vehicle having the configuration described above, it is conceivable to install the decompression device for only a subset of one or more cylinders (that is, one or more but not all the cylinders of the internal combustion engine) for reducing cost. However, if the number of cylinders having the decompression device is decreased without special consideration with regard to which cylinder the decompression device is installed for, the resonance may not be properly reduced in the first power train resonance range described above.

The present disclosure has been made to address the problem described above, and an object of the present disclosure is to provide a hybrid vehicle that can reduce resonance in a first power train resonance range by the use of a decompression device while reducing cost by decreasing the number of cylinders having the decompression device.

A hybrid vehicle according to the present disclosure includes a power train including an internal combustion engine equipped with a plurality of cylinders and a drive motor unit. The drive motor unit includes an electric motor coupled to the internal combustion engine without a clutch interposed between the drive motor unit and the internal combustion engine. The internal combustion engine includes one or more decompression devices that are each installed for a subset of one or more cylinders that are one or more but not all of the plurality of cylinders, the one or more decompression devices operating to release compression pressure in the subset of one or more cylinders in at least one of a course of an engine stop and course of an engine start-up in which combustion is not performed. The subset of one or more cylinders are selected such that, when the one or more decompression devices are operating, compression is not produced sequentially in cylinders that are adjacent to each other in terms of a firing order of the internal combustion engine.

The hybrid vehicle may further include a control device. In stopping an operation of the one or more decompression devices in the course of the engine start-up, the control device may be configured, when an engine speed is higher than an upper limit value of a first power train resonance range and is lower than a lower limit value of a second power train resonance range located on a higher engine speed side relative to the first power train resonance range, to stop the operation of the one or more decompression devices. The first power train resonance range may be an engine speed range that centers on an engine speed value at which a period of excitation due to compression in the internal combustion engine coincides with a natural vibration period of the motor drive unit when the operation of the one or more decompression devices is stopped. The second power train resonance range may be an engine speed range that centers on an engine speed value at which the period of the excitation coincides with the natural vibration period of the drive motor unit when the one or more decompression device are operating.

The hybrid vehicle may further include a control device. In operating the one or more decompression devices in the course of the engine stop, the control device may be configured, when an engine speed is higher than an upper limit value of a first power train resonance range and is lower than a lower limit value of a second power train resonance range located on a higher engine speed side relative to the first power train resonance range, to operate the one or more decompression devices. The first power train resonance range may be an engine speed range that centers on an engine speed value at which a period of excitation due to compression in the internal combustion engine coincides with a natural vibration period of the motor drive unit when an operation of the one or more decompression devices is stopped. The second power train resonance range may be an engine speed range that centers on an engine speed value at which the period of the excitation coincides with the natural vibration period of the drive motor unit when the one or more decompression device are operating.

According to the hybrid vehicle of the present disclosure, the one or more decompression devices are installed for the subset of one or more cylinders that are selected such that, when the one or more decompression devices are operating, compression is not produced sequentially in cylinders that are adjacent to each other in terms of the firing order. According to the internal combustion engine equipped with the one or more decompression devices installed as just described, when the one or more decompression devices are operating, the value of engine speed at which the period of the excitation due to the compression in the internal combustion engine coincides with the natural vibration period of the motor drive unit can be made higher as compared to when the compression is performed in all the cylinders of the internal combustion engine. Therefore, according to the hybrid vehicle of the present disclosure, resonance in the first power train resonance range can be reduced by the use of the one or more decompression devices similarly to the example in which a decompression device is installed for all the cylinders, while reducing cost by decreasing the number of cylinders having the decompression device.

BRIEF DESCRIPTION OF THE DRAWINGS

FIGS. 4A and 4B are diagrams for describing advantageous Effects of installation of the decompression devices to a subset of one or more cylinders (i.e., #2 and #3);

FIG. 5 is a diagram for describing an engine speed range in which resonance is produced in the power train due to compression of an internal combustion engine;

DETAILED DESCRIPTION

Figure 1:
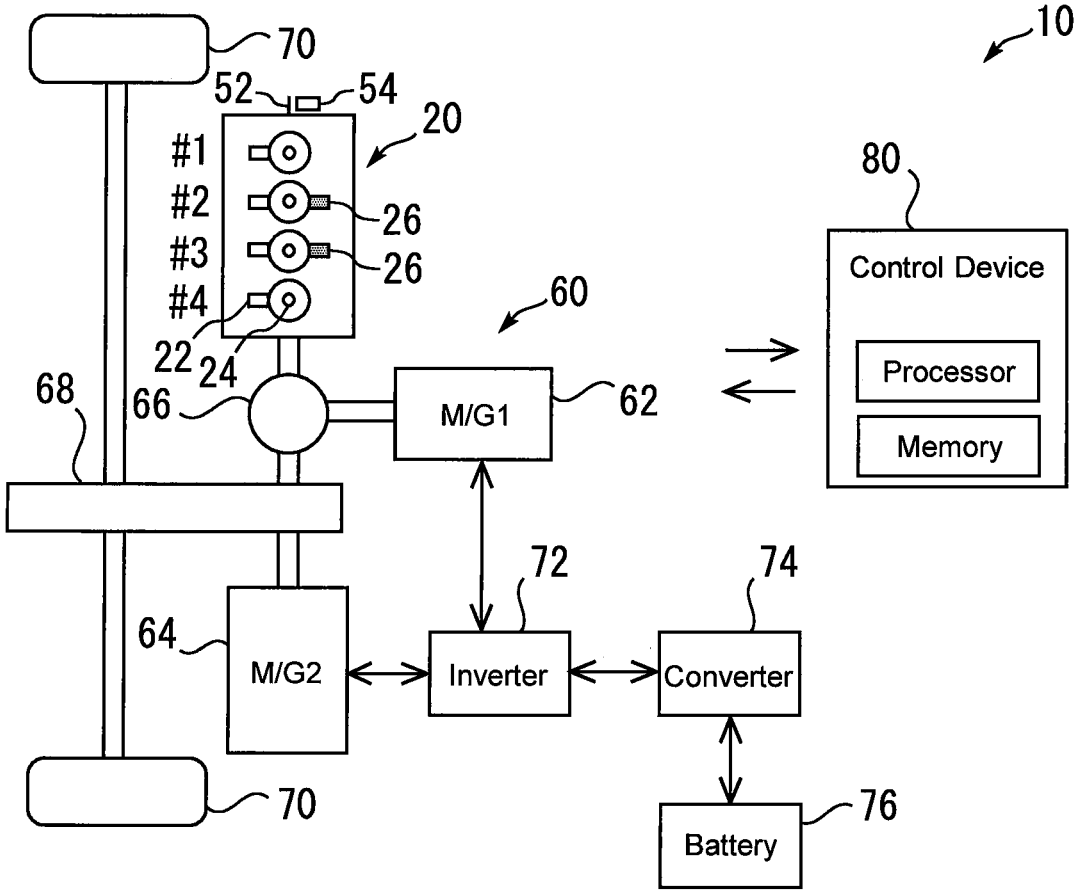
FIG. 1 is a schematic diagram for describing an example of the configuration of a power train of a hybrid vehicle according to a first embodiment of the present disclosure.

In the following embodiments of the present disclosure, the same components in the drawings are denoted by the same reference numerals, and redundant descriptions thereof are omitted or simplified. Moreover, it is to be understood that even when the number, quantity, amount, range or other numerical attribute of an element is mentioned in the following description of the embodiments, the present disclosure is not limited to the mentioned numerical attribute unless explicitly described otherwise, or unless the present disclosure is explicitly specified by the numerical attribute theoretically. Furthermore, structures or steps or the like that are described in conjunction with the following embodiments are not necessarily essential to the present disclosure unless explicitly shown otherwise, or unless the present disclosure is explicitly specified by the structures, steps or the like theoretically.

1. First Embodiment

Firstly, a first embodiment according to the present disclosure will be described with reference to FIGS. 1 to 5.

1-1. Example of Configuration of Power Train of Hybrid Vehicle

FIG. 1 is a schematic diagram for describing an example of the configuration of a power train 10 of a hybrid vehicle according to the first embodiment of the present disclosure. The power train 10 shown in FIG. 1 is provided with an internal combustion engine 20 and a drive motor unit 60 as power sources of the hybrid vehicle.

1-1-1. Internal Combustion Engine (In-Line Four-Cylinder)

As an example, the internal combustion engine 20 is a spark ignition in-line four-cylinder engine and has first to fourth cylinders #1 to #4 in order from its one end in the cylinder row direction. However, an internal combustion engine according to the present disclosure may alternatively be a compression ignition engine, as long as it has a plurality of cylinders.

The internal combustion engine 20 is equipped with fuel injection valves 22 and an ignition device 24 (only spark plugs are illustrated). Each of the fuel injection valves 22 is arranged in a cylinder, and, as an example, injects fuel directly into the cylinder. The ignition device 24 ignites an air-fuel mixture in each cylinder by the use of the spark plug arranged for each cylinder.

Figure 2:
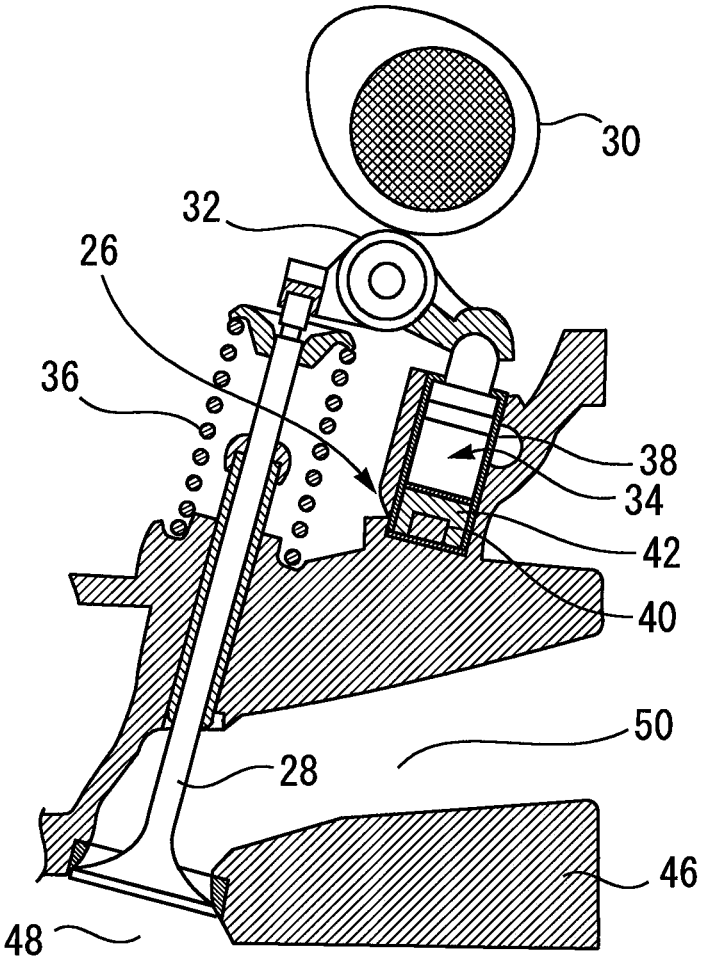
FIG. 2 is a schematic diagram for describing an example of the concrete configuration of a decompression device shown in FIG. 1.
Figure 3:
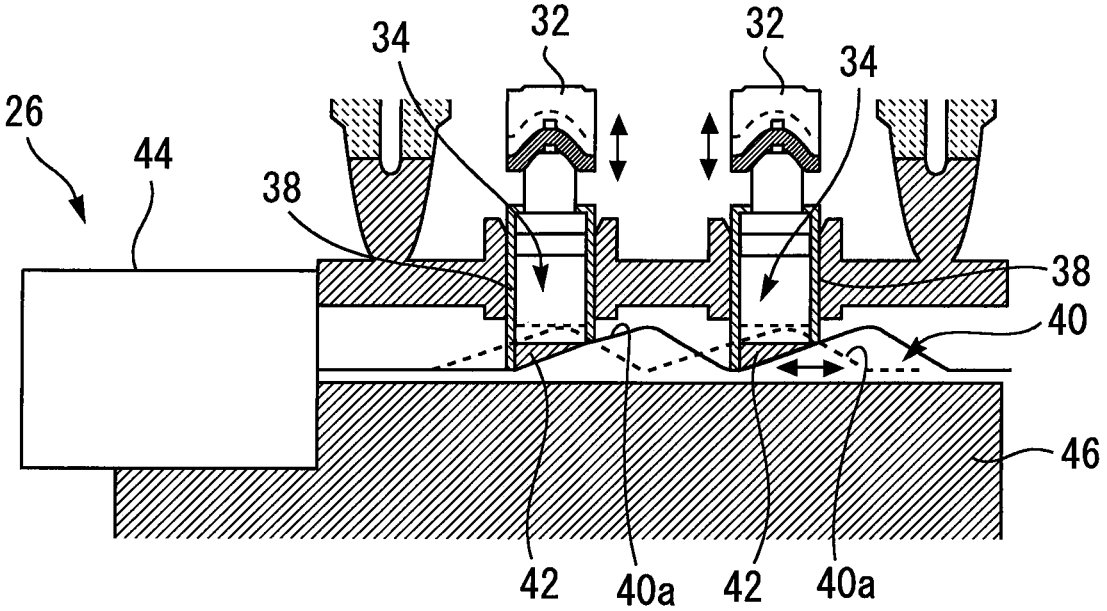
FIG. 3 is a schematic diagram for describing an example of the concrete configuration of the decompression device shown in FIG. 1.

The internal combustion engine 20 is further equipped with decompression devices 26. An example of selection of cylinders for which the decompression device 26 is provided will be described later. FIGS. 2 and 3 are schematic diagrams for describing an example of the concrete configuration of the decompression device 26 shown in FIG. 1. It should be noted that FIGS. 2 and 3 represent the configuration concerning the cylinders having the decompression device 26.

FIG. 2 illustrates an intake valve 28, a rocker arm 32 that transmits pressing force from an intake cam 30 to the intake valve 28, and a hydraulic lash adjustor (HLA) 34 that supports the rocker arm 32 at its end portion located on the non-valve side. The intake valve 28 is urged, by a valve spring 36, in its closing direction (that is, a direction to push up the rocker arm 32).

FIG. 3 illustrates two rocker arms 32 and two HLAs 34 that are respectively associated with two (one example) intake valves 28 in each cylinder for which the decompression device 26 is installed. As shown in FIG. 3, the decompression device 26 is equipped with HLA holders 38, a slider 40, HLA lifters 42 and an actuator 44.

To be more specific, each of the HLA holders 38 is fixed to a cylinder head 46, formed into a bottomed cylindrical shape and houses the corresponding HLA 34 such that it can be lifted and lowered. Each of the sliders 40 is driven by the corresponding actuator 44 to reciprocate in the cylinder row direction (i.e., the left-right direction in FIG. 3). Each of the sliders 40 has a cam surface 40*a* for transforming the reciprocating motion of the slider 40 to the lifting and lowering motion of the corresponding HLA 34 (i.e., reciprocating motion in the top-bottom direction of FIG. 3). Each of the HLA lifters 42 is interposed between the bottom surface of the corresponding HLA 34 and the cam surface 40*a* of the corresponding slider 40. The actuators 44 are of electrically driven type, for example.

Each of the HLAs 34 operates so as to always eliminate a clearance between the intake cam 30 and the rocker arm 32 with its original function (i.e., expansion and contraction motion). On that basis, the position of the slider 40 is adjusted by the use of the actuator 44, and, as a result, the intake valve 28 can be caused to remain open, by the use of the HLA 34, regardless of application of the pressing force of the intake cam 30 to the rocker arm 32. More specifically, when the cam surface 40*a* is located as shown by the solid line in FIG. 3, the intake valve 28 normally opens and closes. In contrast to this, if the actuator 44 is driven such that the cam surface 40*a* moves to a position shown by the broken line, the HLA 34 lifts, by the effects of the cam surface 40*a*, on the side of the rocker arm 32 via the HLA lifter 42. If a state of the HLA 34 being lifted is achieved, the intake valve 28 can be caused to remain open regardless of application of the pressing force of the intake cam 30 to the rocker arm 32.

Since, as a result, a combustion chamber 48 of the cylinder having the decompression device 26 and an intake air passage 50 can always communicate with each other, the in-cylinder pressure (i.e., compression pressure) in the compression stroke can be released in the cylinder the decompression device 26. Hereunder, an operation to release the compression pressure in each cylinder in this manner is referred to as a "decompression operation"

According to the decompression device 26 configured as described above, by operating the actuator 44 to lift the HLA 34 as described above, a "decompression operating state" in which the decompression operation is performed is achieved. On the other hand, by operating the actuator 44 such the lifting of the HLA 34 is eliminated, a "decompression stop state" in which the decompression operation is not performed is obtained (even if the crankshaft 52 is rotating). As just described, the decompression device 26 can select between the decompression operating state and the decompression stop state by controlling the actuator 44. It should be noted that the concrete configuration of a decompression device according to the present disclosure is not limited to the example shown in FIGS. 2 and 3. That is to say, if the compression pressure in the cylinder can be released, a decompression device having any other known configuration can be adopted.

Furthermore, a crank angle sensor 54 that outputs a signal responsive to the crank angle is arranged in the vicinity of the crankshaft 52 of the internal combustion engine 20.

1-1-2. Drive Motor Unit

The drive motor unit 60 is equipped with a first motor generator (M/G1) 62 and a second motor generator (M/G2) 64, which each correspond to an electric motor that can generate electric power, and a power split device 66. The motor generator 62 and the motor generator 64 are alternate current synchronous motor generators having both a function as an electric motor that outputs a torque using a supplied electric power and a function as a generator that transduces an inputted mechanical power into the electric power. The first motor generator 62 is mainly used as a generator, and the second motor generator 64 is mainly used as an electric motor. Hereunder, for ease of explanation, the first motor generator 62 is simply noted as the generator 62, and the second motor generator 64 is simply noted as the motor 64.

The internal combustion engine 20, the generator 62 and the motor 64 are coupled to wheels 70 via the power split device 66 and a speed reducer 68. The power split device 66 is, for example, a planetary gear unit and splits the torque outputted from the internal combustion engine 20 into torques of the generator 62 and the wheels 70. To be more specific, in the power split device 66: a sun gear is coupled to a rotational shaft of the generator 62; a planetary carrier is coupled to the crankshaft 52 of the internal combustion engine 20; and a ring gear is coupled to a rotational shaft of the motor 64. The torque outputted from the internal combustion engine 20 or the torque outputted from the motor 64 is transmitted to the wheels 70 via the speed reducer 68. The generator 62 regenerates electric power using a torque supplied from the internal combustion engine 20 via the power split device 66.

The generator 62 and the motor 64 each perform the supply and receipt of the electric power with a battery 76 via an inverter 72 and a converter 74. The inverter 72 converts the direct current of the electric power stored in the battery 76 into the alternate current to supply the motor 64 with this alternate current, and converts the alternate current of the electric power generated by the generator 62 into the direct current to store the battery 76. As a result, the battery 76 is charged with the electric power generated by the generator 62, and the electric power stored in the battery 76 is discharged when it is consumed by the motor 64.

According to the power train 10 configured as described above, cranking for the start-up of the internal combustion engine 20 is performed by the use of the generator 62 that serves as an electric motor. That is to say, the cranking of the internal combustion engine 20 is performed by the use of the generator 62 coupled to the internal combustion engine 20 without a clutch interposed therebetween. It should be noted that the generator 62 corresponds to an example of the "electric motor" according to the present disclosure.

1-1-3. Control Device

The hybrid vehicle according to the present embodiment is provided with a control device 80 for controlling the power train 10. The control device 80 is an electronic control unit (ECU) that includes at least one processor, at least one memory, and an input/output interface.

The input/output interface receives sensor signals from various sensors mounted on the internal combustion engine 20 and the hybrid vehicle on which the internal combustion engine 20 is mounted, and also outputs actuating signals to various actuators for controlling the operation of the internal combustion engine 20 and the hybrid vehicle. The various sensors described above include the crank angle sensor 54. The control device 80 can calculate an engine speed NE by the use of the signal of the crank angle sensor 54. Furthermore, the various actuators described above include the fuel injection valves 22, the ignition device 24, the decompression devices 26 (actuators 44) and the motor generators 62 and 64 that are described above.

In the memory of the control device 80, various programs and various data (including maps) for controlling the hybrid vehicle are stored. The processor executes the programs stored in the memory. As a result, various functions of the control device 80 (such as, engine control and vehicle running control) are achieved. It should be noted that the control device 80 may alternatively be configured with a plurality of ECUs.

1-1-4. Example of Selection of Cylinders Having Decompression Device

As shown in FIG. 1, the decompression device 26 is not installed for each of all the cylinders of the internal combustion engine 20 but is installed for each of a second cylinder #2 and a third cylinder #3 that correspond to an example of a subset of one or more cylinders (i.e., one or more but not all the cylinders of the internal combustion engine 20). In more detail, an example of the firing order of the internal combustion engine 20 is a first cylinder #1, the third cylinder #3, a fourth cylinder #4 and the second cylinder #2. Namely, according to the internal combustion engine 20, the decompression device 26 is provided for each of the subset of one or more cylinders (#2 and #3) that are selected such that compression is not produced sequentially in cylinders that are adjacent to each other in terms of the firing order when all the decompression devices 26 (i.e., two decompression devices 26) are each in the decompression operating state.

1-2. Control of Decompression Device

According to the in-line four-cylinder internal combustion engine 20, the compression stroke arrives at 180 degrees CA interval. Because of this, if the decompression devices 26 of the cylinders #2 and #3 are each in the decompression stop state, the compression is periodically produced (that is, the compressions is produced twice per revolution of the crankshaft 52) in the respective cylinders #1 to #4 at 180 degrees CA interval in order according to the firing order. The work of this compression becomes a key factor of the engine speed fluctuation. It should be noted that, more strictly, the engine speed fluctuation that becomes a factor of resonance affects not only the compression stroke in which the compression is produced but also the expansion stroke in which the compression is released.

As described above, the internal combustion engine 20 is coupled to the drive motor unit 60 without a clutch interposed therebetween. Because of this, the compression of the internal combustion engine 20 that is periodically produced as described above serves as an excitation force that affects the drive motor unit 60. The drive motor unit 60 has a normal frequency depending on its size. Thus, in the decompression stop state, when the engine speed NE passes through a range (which corresponds to a "first power train resonance range" shown in FIG. 5 described later) in both the course of engine stop and the course of engine start-up, the period of excitation due to the compression described above coincides with or becomes closer to the natural vibration period (=1/natural vibration frequency) of the drive motor unit 60, and the resonance of the power train 10 is excited. As a result, the noise and vibration are produced in the hybrid vehicle.

Accordingly, in the course of the engine stop, the control device 80 controls the decompression devices 26 such that the decompression operating state is selected before the first power train resonance range is reached. In addition, in the course of the engine start-up that is reached with the decompression operating state, the control device 80 controls the decompression devices 26 such that the decompression stop state is selected after passage of the first power train resonance range. It should be noted that, if, contrary to the above, the course of the engine start-up is reached with the decompression stop state, the control device 80 may control the decompression devices 26 such that the decompression operating state is selected before the first power train resonance range is reached and may also control the decompression devices 26 such that the decompression stop state is selected after passage of the first power train resonance range.

It should be noted that the "course of engine stop" mentioned here corresponds to a duration from the start of fuel cut for an engine stop until the completion of the engine stop (i.e., engine speed NE=0). Also, the "course of engine start-up" corresponds to a duration from the start of cranking until the start of fuel injection. In addition, in the internal combustion engine 20 that is coupled to the drive motor unit 60, the engine stop can be performed while the energization to the generator (M/G1) 62 is stopped.

1-3. Advantageous Effects Associated with Selection of Cylinders Having Decompression Device FIGS. 4A and 4B are diagrams for describing the advantageous Effects of the installation of the decompression devices 26 to the subset of one or more cylinders (i.e., #2 and #3). It should be noted that FIGS. 4A and 4B show relationships under a constant engine speed NE. In addition, circles indicated by hatching show the cylinders in which compression is performed, and circles without hatching show the cylinders in which compression is not performed.

The firing order of the internal combustion engine 20 is #1, #3, #4 to #2 as described above. For comparison with the internal combustion engine 20 according to the present embodiment, FIG. 4A shows an example of an in-line four-cylinder engine whose firing order is the same as that of the internal combustion engine 20 and a decompression device is not installed for any cylinders. In this example, the compression is performed in all the cylinders. Therefore, as shown in FIG. 4A, the period of the excitation has a value depending on the explosion interval (180 degrees CA).

On the other hand, according to the internal combustion engine 20 of the present embodiment, the decompression device 26 is installed for each of the second cylinder #2 and the third cylinder #3. Because of this, if all the decompression devices 26 (i.e., two decompression devices 26) of the internal combustion engine 20 are each in the decompression operating state, the compression can be prevented from being sequentially produced in the cylinders that are adjacent to each other in terms of the firing order as shown in FIG. 4B. Accordingly, the period of the excitation doubles with respect to that in the example shown in FIG. 4A.

FIG. 5 is a diagram for describing an engine speed range in which the resonance is produced in the power train 10 due to the compression of the internal combustion engine 20. It should be noted that the engine speed range shown in FIG. 5 is a low speed range that is lower than the idling speed (that is, that is used in the course of the engine stop and also the course of the engine start-up).

An engine speed value NE1 in FIG. 5 corresponds to a value of the engine speed NE at which the period of the excitation due to the compression in the example of the in-line four-cylinder engine shown in FIG. 4A coincides with the natural vibration frequency of the drive motor unit 60. The resonance in this example occurs in the "first power train resonance range" that centers on the engine speed value NE1 (in other words, that is an engine speed range including the engine speed value NE1 and located in the vicinity of the engine speed value NE1). In the internal combustion engine 20 according to the present embodiment, if the engine speed NE passes through the first power train resonance range when the decompression devices 26 in the second cylinder #2 and the third cylinder #3 are each in the decompression stop state, the resonance is similarly produced in the power train 10.

On the other hand, if both the decompression devices 26 in the second cylinder #2 and the third cylinder #3 are put in the decompression operating state in the internal combustion engine 20 according to the present embodiment, the period of the excitation can be made longer as described above. Therefore, even if the engine speed NE passes through the first power train resonance range, the resonance in the power train 10 is reduced.

An engine speed value NE2 in FIG. 5 corresponds to a value twice as much as the engine speed value NE1 described above. Also, if both the decompression devices 26 in the second cylinder #2 and the third cylinder #3 are put in the decompression operating state, the period of the excitation due to the compression coincides with the natural vibration period of the drive motor unit 60 at this engine speed value NE2. Thus, the resonance in this example occurs in the "second power train resonance range" that centers on the engine speed value NE2 (in other words, that is an engine speed range including the engine speed value NE2 and located in the vicinity of the engine speed value NE2).

As described above, the subset of one or more cylinders (#2 and #3) are selected to install the decompression devices 26 such that the compression is not sequentially produced in the cylinders that are adjacent to each other in terms of the firing order, whereby the engine speed range (i.e., power train resonance range) in which the resonance is produced in the power train 10 can be made higher. As a result, even in the internal combustion engine 20 in which the decompression devices 26 are installed for only the subset of one or more cylinders, the resonance can be reduced while the engine speed Ne passes through the first power train resonance range, similarly to the example in which the decompression devices 26 are arranged in the all the cylinders. Therefore, the vibration and noise of the hybrid vehicle in the first power train resonance range can be reduced.

1-4. Other Examples of Cylinders in which Decompression Devices is Installed for in-Line Four-Cylinder Engine According to the first embodiment described above, the decompression device 26 of the internal combustion engine 20 whose firing order is the first cylinder #1, the third cylinder #3, the fourth cylinder #4 and the second cylinder #2 is installed for each of the second cylinder #2 and the third cylinder #3. Instead of this kind of example, the decompression device 26 may be installed for each of the first cylinder #1 and the fourth cylinder #4. Alternatively, even in an in-line four-cylinder engine whose firing order is different from that in the example described above, the decompression device 26 may be installed for each of the subset of one or more cylinders that are selected such that the compression is not sequentially produced in the cylinders that are adjacent to each other in terms of the firing order, similarly to the example described above.

Furthermore, another example of the "subset of one or more cylinders" in an in-line four-cylinder engine may be any desired combination of three cylinders. Even in this kind of example, the compression can be prevented from being sequentially produced in cylinders that are adjacent to each other in terms of the firing order. In addition, according to this example, the period of the excitation in the decompression operating state becomes even longer than that in the first embodiment. As a result, an engine speed range in which the resonance is produced in the power train 10 is made even higher.

2. Second Embodiment

Next, a second embodiment according to the present disclosure will be described with reference to FIGS. 6 to 9. In the following explanation, it is supposed that the configuration shown in FIG. 1 is used as an example of the configuration of a power train of a hybrid vehicle according to the second embodiment.

Figure 6:
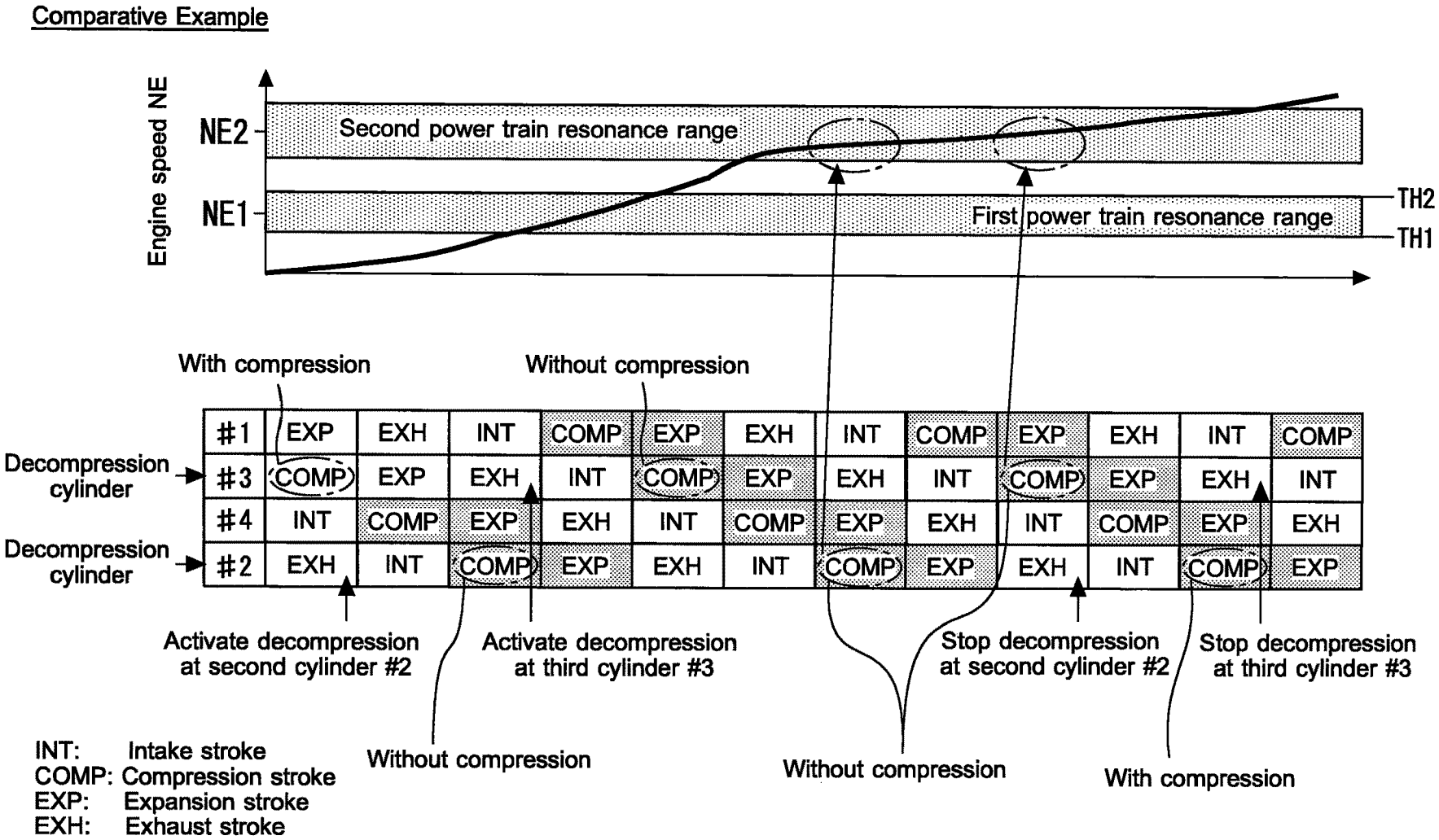
FIG. 6 is a diagram for describing an issue on installation of the decompression devices into the subset of one or more cylinders (#2 and #3) as in the first embodiment.

2-1. Control of Decompression Device 2-1-1. Control in Course of Engine Start-Up FIG. 6 is a diagram for describing an issue on installation of the decompression devices 26 into the subset of one or more cylinders (#2 and #3) as in the first embodiment. FIG. 6 indicates an operation of the decompression devices 26 in the course of the engine start-up. It should be noted that, to simply describe stokes in which the individual cylinders are in the course of the engine start-up, FIG. 6 represents a temporal change of the engine speed NE associated with the individual strokes in each cylinder. Thus, the horizontal axis of FIG. 6 is not strictly time itself. This also applies to an example shown in FIG. 7 described below.

According to the example shown in FIG. 6, in order to reduce the resonance when passing through the first power train resonance range, the decompression devices 26 in the second cylinder #2 and the third cylinder #3 are controlled so as to be put in the decompression operating state before passing through the first power train resonance range (i.e., before reaching a lower limit value TH1 thereof). After the decompression operating state is selected in this way, it is required to switch again to the decompression stop state before the start of the combustion.

According to the example shown in FIG. 6, a timing to switch to the decompression stop state is late and, as a result, the compression strokes in the second cylinder #2 and the third cylinder #3 pass through the second power train resonance range with the decompression operating state (i.e., without the compression). As a result, the resonance may be produced when passing through the second power train resonance range.

Figure 7:
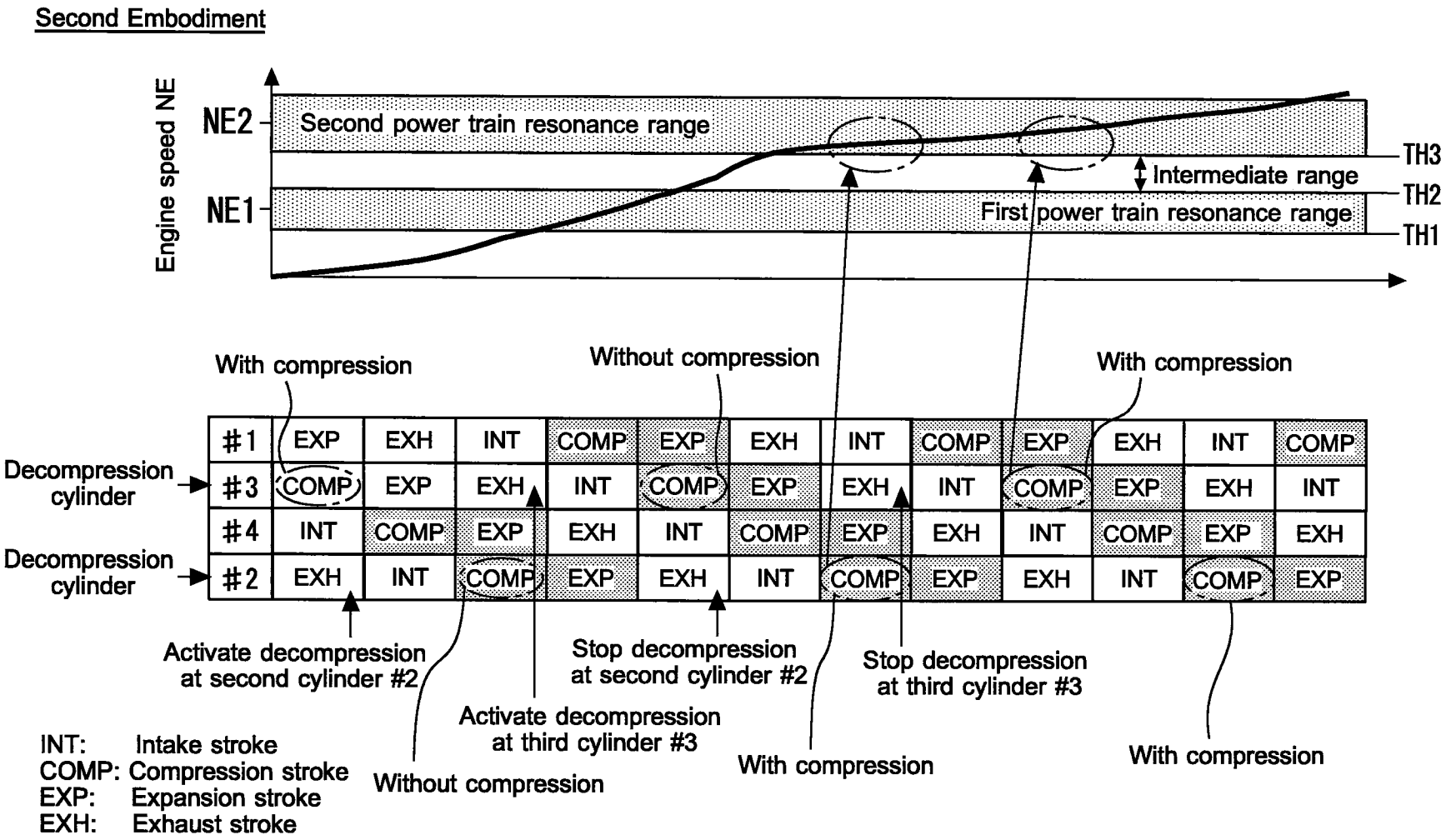
FIG. 7 is a diagram for describing control of the decompression device according to a second embodiment of the present disclosure.

FIG. 7 is a diagram for describing control of the decompression device 26 according to the second embodiment of the present disclosure. As shown in FIG. 7, according to the present embodiment, switching from the decompression operating state to the decompression stop state is performed in an engine speed range (hereunder, referred to as an "intermediate range") located between (an upper limit value TH2 of) the first power train resonance range and (a lower limit value TH3 of) the second power train resonance range.

2-1-2. Control in Course of Engine Stop

The control of the decompression device 26 in the course of the engine stop is performed in the same way as that of the control in the course of the engine start-up described above. In detail, in the course of the engine stop, it is required, in order to reduce the resonance when passing through the first power train resonance range, to control the decompression devices 26 in the second cylinder #2 and the third cylinder #3 such that the decompression stop state is achieved before passing through the first power train resonance range (i.e., before reaching the upper limit value TH2 thereof). However, if the engine speed NE at which this switching to the decompression stop state is performed is too high, the resonance may be produced during passage of the second power train resonance range.

Accordingly, according to the present embodiment, the switching from the decompression stop state to the decompression operating state in the course of the engine stop is performed in the above-mentioned intermediate range (TH2<NE<TH3).

Figure 8:
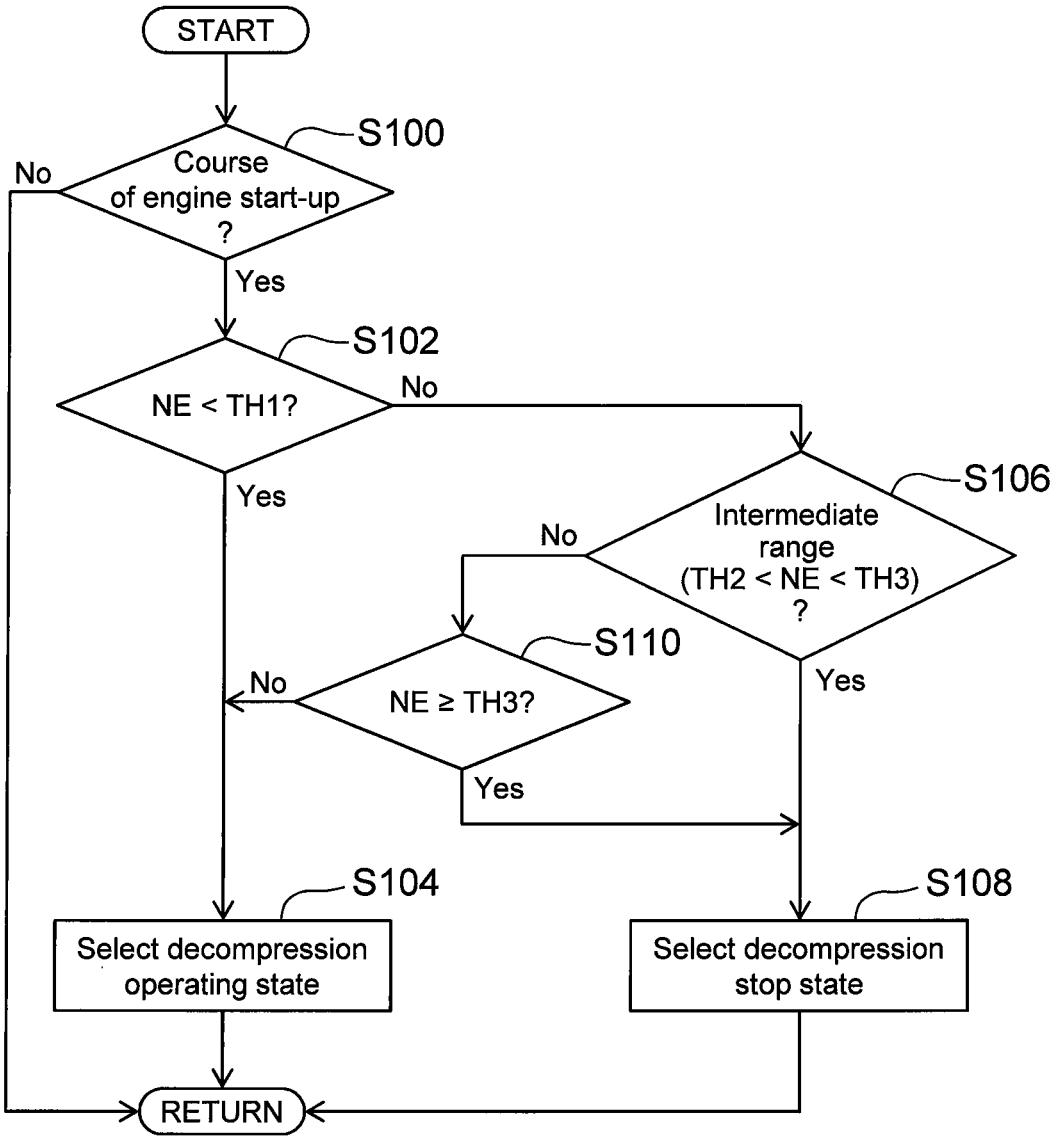
FIG. 8 is a flow chart that illustrates a routine of the processing concerning control of the decompression device in the course of engine start-up according to the second embodiment of present disclosure.

2-2. Processing of ECU Concerning Control of Decompression Device 2-2-1. Processing of Course of Engine Start-up FIG. 8 is a flow chart that illustrates a routine of the processing concerning the control of the decompression device 26 in the course of the engine start-up according to the second embodiment of present disclosure. The control device 80 repeatedly executes the processing of the present routine individually for the cylinders (#2 and #3) having the decompression device 26 and for each cycle of the internal combustion engine 20.

According to the routine shown in FIG. 8, firstly, the control device 80 determines whether or not the internal combustion engine 20 is in the course of the engine start-up (step S100). Whether or not this determination is met is performed on the basis of, for example, whether or not there is an engine start-up command based on an engine start-up request from a driver of the hybrid vehicle or the system of the power train 10.

If the determination result of step S100 is negative, the present routine is ended. If, on the other hand, the determination result of step S100 is positive, the control device 80 determines whether or not the engine speed NE is lower than a predetermined speed threshold value (i.e., the lower limit value TH1 of the first power train resonance range) (step S102).

If the determination result of step S102 is positive (NE<TH1), the control device 80 controls the decompression device 26 in the second cylinder #2 and the third cylinder #3 such that the decompression operating state is selected (step S104). It should be noted that, if the processing proceeds to step S104 during the decompression operating state being already selected, the decompression operating state is maintained.

If, on the other hand, the determination result of step S102 is negative (NE≥TH1), the processing proceeds to step S106. In step S106, the control device 80 determines whether or not the engine speed NE is in the above-mentioned intermediate range (TH2<NE<TH3). As a result, if the determination result of step S106 is positive, the control device 80 controls the decompression device 26 in the second cylinder #2 and the third cylinder #3 such that the decompression stop state is selected (step S108). It should be noted that, if the processing proceeds to step S108 during the decompression stop state being already selected, the decompression stop state is maintained.

If, on the other hand, the determination result of step S106 is negative (TH1≤NE≤TH2, or NE≥TH3), the processing proceeds to step S110. In step S110, the control device 80 determines whether or not the engine speed NE is higher than or equal to a predetermined speed threshold value (i.e., the lower limit value TH3 of the second power train resonance range).

If the determination result of step S110 is negative (that is, TH1≤NE≤TH2), the control device 80 proceeds to step S104 to select (continue) the decompression operating state. If, on the other hand, the determination result of step S110 is positive (NE≥TH3), the control device 80 proceeds to step S108 to select (continue) the decompression stop state.

2-2-2. Processing of Course of Engine Stop

Figure 9:
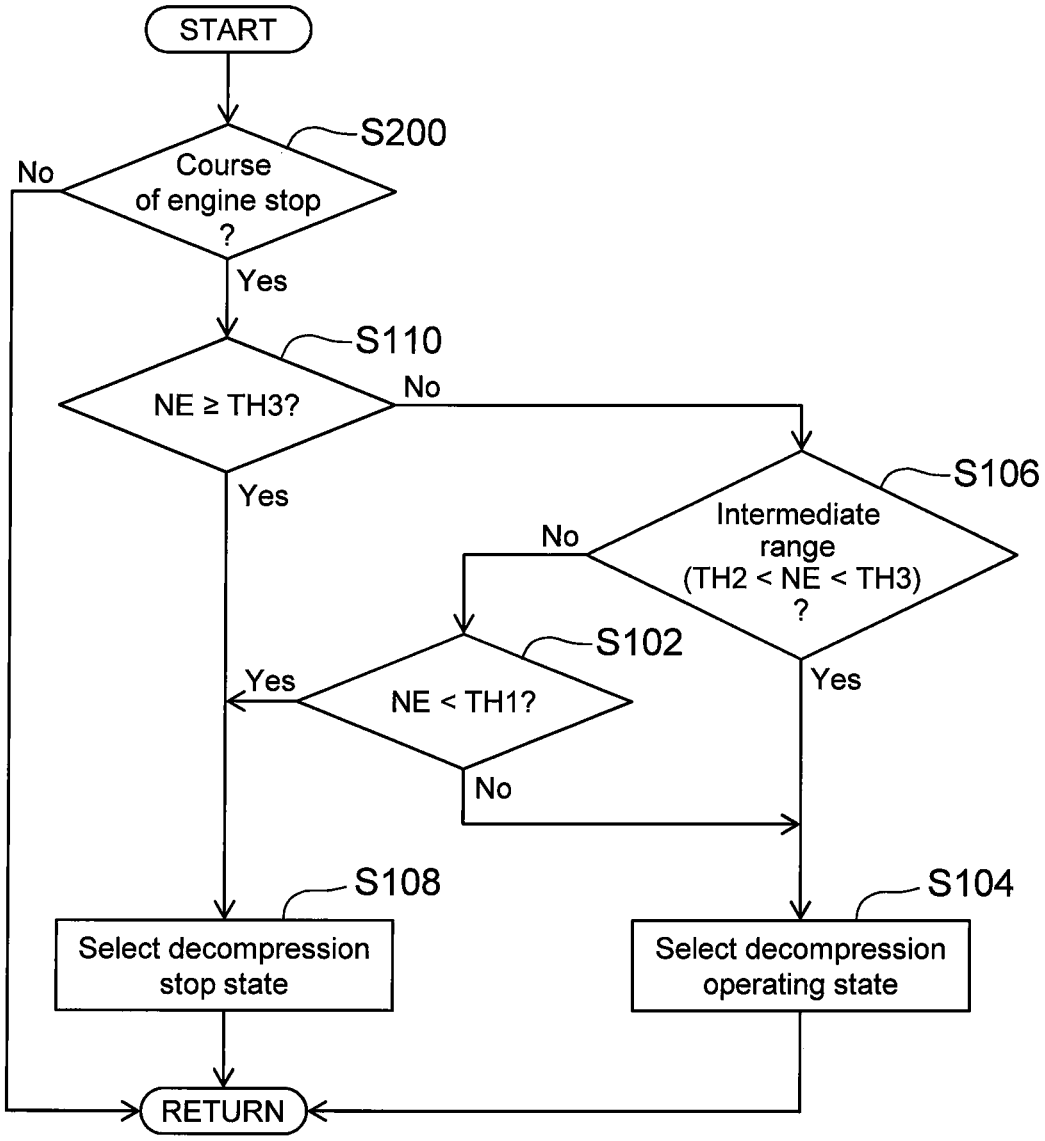
FIG. 9 is a flow chart that illustrates a routine of the processing concerning control of the decompression device in the course of engine stop according to the second embodiment of present disclosure.

FIG. 9 is a flow chart that illustrates a routine of the processing concerning the control of the decompression device 26 in the course of the engine stop according to the second embodiment of present disclosure. The contents itself of the processing of steps S102 to S110 in the routine shown in FIG. 9 is the same as that of the routine shown in FIG. 8. However, the routine shown in FIG. 9 is different from the routine shown in FIG. 8 in the order of execution of the processing of steps S102 to S110, as described below.

According to the routine shown in FIG. 9, firstly, the control device 80 determines whether or not the internal combustion engine 20 is in the course of the engine stop (step S200). Whether or not this determination is met is performed on the basis of, for example, whether or not there is an engine stop command based on an engine stop request from a driver of the hybrid vehicle or the system of the power train 10.

If the determination result of step S200 is negative, the present routine is ended. If, on the other hand, the determination result of step S200 is positive, the control device 80 executes the determination of step S110. If, as a result, this determination result is positive (NE≥TH3), the control device 80 controls the decompression devices 26 such that the decompression stop state is selected (step S108).

If, on the other hand, the determination result of step S110 is negative (NE<TH3), the control device 80 executes the determination of step S106. If, as a result, this determination result is positive (TH2<NE<TH3), the control device 80 controls the decompression devices 26 such that the decompression operating state is selected (step S104).

If, on the other hand, the determination result of step S106 is negative (NE≤TH2), the control device 80 executes the determination of step S102. If, as a result, this determination result is negative (TH1≤NE≤TH2), the control device 80 proceeds to step S104 to select (continue) the decompression operating state. If, on the other hand, the determination result of step S102 is positive (NE<TH1), the control device 80 proceeds to step S108 to select (continue) the decompression stop state.

2-3. Advantageous Effects Concerning Control of Decompression Devices

According to the routine shown in FIG. 8, the switching from the decompression operating state to the decompression stop state in the course of the engine start-up is performed in the above-mentioned intermediate range (TH2<NE<TH3). This makes it possible to put, into the decompression stop state, the cylinders (#2 and #3) having the decompression device 26, after passing through the first power train resonance range and before entering into the second power train resonance range.

Moreover, according to the routine shown in FIG. 9, the switching from the decompression stop state to the decompression operating state in the course of the engine stop is performed in the above-mentioned intermediate range (TH2<NE<TH3). This makes it possible to put, into the decompression operating state, the cylinders (#2 and #3) having the decompression device 26, after passing through the second power train resonance range and before entering into the first power train resonance range.

According to the control of the decompression device 26 of the present embodiment described so far, not only the resonance due to the passage of the first power train resonance range but also the resonance due to the passage of the second power train resonance range with the decompression operating state can be reduced in the course of the engine start-up and course of the engine stop. Therefore, the vibration and noise of the hybrid vehicle can be properly reduced while reducing cost due to a decrease of the cylinders having the decompression device 26.

In addition, it is supposed that, contrary to the example described with reference to FIGS. 6 to 9, there is another example in which returning to the decompression stop state is not performed after the decompression operating state is selected in the course of the engine stop. According to this kind of example, the engine start-up is thereafter started with the decompression operating state. The control of the decompression device 26 in this example can be performed as follows, for example. That is to say, with regard to the course of the engine stop, the processing of step S102 may be deleted from the routine shown in FIG. 9 and, when the determination result of step S106 becomes negative, the processing of the routine may be ended. In addition, with regard to the courser of the engine start-up, the processing of steps S102, S104 and S110 may be deleted from the routine shown in FIG. 8 and, when the determination result of step S106 becomes negative, the processing of the routine may be ended.

3. Third Embodiment

Figure 10A:
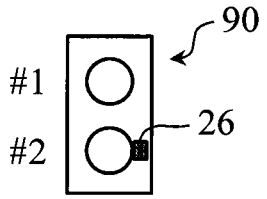
FIGS. 10A and 10B are diagrams for describing an example of selection of cylinders having the decompression device with respect to an in-line two-cylinder internal combustion engine.

Next, a third embodiment according to the present disclosure will be described with reference to FIGS. 10A and 10B. A hybrid vehicle according to the present embodiment is the same as the hybrid vehicle according to the first embodiment except that an in-line two-cylinder internal combustion engine 90 (see FIG. 10A) is included instead of the in-line four-cylinder internal combustion engine 20.

3-1. Example of Selection of Cylinder Having Decompression Device in in-Line Two-Cylinder Engine FIGS. 10A and 10B are diagrams for describing an example of selection of the cylinders having the decompression device 26 with respect to the in-line two-cylinder internal combustion engine 90. The firing order of this internal combustion engine 90 is #1 to #2. According to the example shown in FIG. 10A, the decompression device 26 is installed for the second cylinder #2 that corresponds to an example of the "subset of one or more cylinders" of the internal combustion engine 90.

Figure 10B:
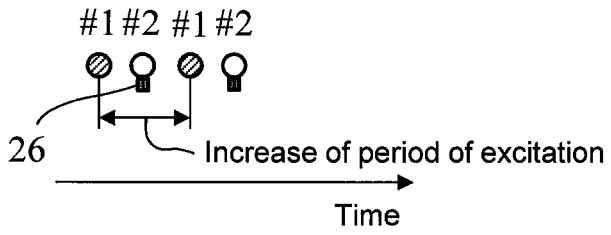

FIG. 10B represents, in association with the firing order, the presence or absence of compression in each cylinder while all the decompression device 26 (i.e., one decompression device 26) of the internal combustion engine 90 is in the decompression operating state. According to the example of selection of the cylinder having the decompression device 26 shown in FIG. 10A, the compression in the in-line two-cylinder internal combustion engine 90 can also be prevented from being sequentially produced in the cylinders that are adjacent to each other in terms of the firing order, as shown in FIG. 10B. Thus, the power train resonance range can be made higher by increasing the period of the excitation, as compared to when the compression is produced in all the cylinders of the internal combustion engine 90. Therefore, similarly to the first embodiment, the resonance can be reduced when passing through the first power train resonance range.

It should be noted that the control of the decompression device 26 described in the second embodiment may alternatively be performed for the internal combustion engine 90 in which the decompression device 26 is installed only in the subset of one or more cylinders (#2). This also applies to fourth to sixth embodiments described later.

3-2. Another Example of Selection of Cylinder Having Decompression Device in in-Line Two-Cylinder Engine A cylinder having the decompression device 26 in the in-line two-cylinder internal combustion engine 90 may be the first cylinder #1 instead of the example described above.

4. Fourth Embodiment

Figure 11A:
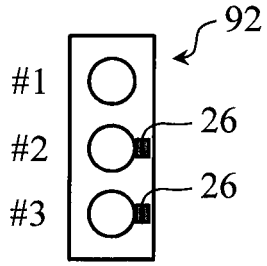
FIGS. 11A and 11B are diagrams for describing an example of selection of cylinders having the decompression device with respect to an in-line three-cylinder internal combustion engine.

Next, a fourth embodiment according to the present disclosure will be described with reference to FIGS. 11A and 11B. A hybrid vehicle according to the present embodiment is the same as the hybrid vehicle according to the first embodiment except that an in-line three-cylinder internal combustion engine 92 (see FIG. 11A) is included instead of the in-line four-cylinder internal combustion engine 20.

4-1. Example of Selection of Cylinders Having Decompression Device in in-Line Three-Cylinder Engine FIGS. 11A and 11B are diagrams for describing an example of selection of the cylinders having the decompression device 26 with respect to the in-line three-cylinder internal combustion engine 92. The firing order of this internal combustion engine 92 is #1, #2 to #3. According to the example shown in FIG. 11A, the decompression device 26 is installed for each of the second cylinder #2 and the third cylinder #3 that correspond to an example of the "subset of one or more cylinders" of the internal combustion engine 92.

Figure 11B:
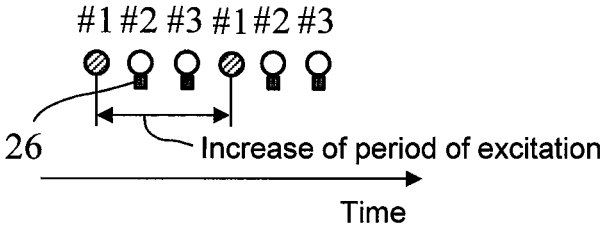

FIG. 11B represents, in association with the firing order, the presence or absence of the compression in each cylinder while all the decompression devices 26 (i.e., two decompression devices 26) of the internal combustion engine 92 are in the decompression operating state. The example shown in FIG. 11B does not also produce the compression sequentially in the cylinders that are adjacent to each other in terms of the firing order. Therefore, similarly to the first to third embodiments, when passing through the first power train resonance range, the resonance can be reduced as a result of an increase of the power train resonance range associated with an increase of the period of the excitation.

4-2. Another Example of Selection of Cylinders Having Decompression Device in In-Line Three-Cylinder Engine The cylinders having the decompression device 26 in the in-line three-cylinder internal combustion engine 92 may be a combination of the first cylinder #1 and the third cylinder #3 or a combination of the first cylinder #1 and the second cylinder #2, instead of the example described above.

5. Fifth Embodiment

Figure 12A:
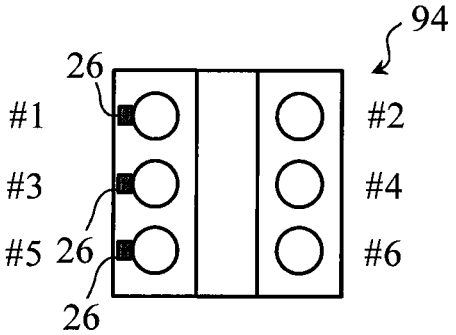
FIGS. 12A and 12B are diagrams for describing an example of selection of cylinders having the decompression device with respect to a V-type six-cylinder internal combustion engine.

Next, a fifth embodiment according to the present disclosure will be described with reference to FIGS. 12A and 12B. A hybrid vehicle according to the present embodiment is the same as the hybrid vehicle according to the first embodiment except that a V-type six-cylinder internal combustion engine 94 (see FIG. 12A) is included instead of the in-line four-cylinder internal combustion engine 20.

5-1. Example of Selection of Cylinders Having Decompression Device in V-Type Six-Cylinder Engine FIGS. 12A and 12B are diagrams for describing an example of selection of the cylinders having the decompression device 26 with respect to the V-type six-cylinder internal combustion engine 94. The numbering rule of cylinders in this internal combustion engine 94 is as shown in FIG. 12A. That is to say, the cylinder numbers are assigned to the left and right banks mutually from one end in the cylinder row direction. This also applies to a V-type eight-cylinder internal combustion engine 96 described later.

An example of the firing order in this internal combustion engine 94 is #1, #2, #3, #4, #5 and #6. In the example shown in FIG. 12A, the decompression device 26 is installed for each of the first cylinder #1, the third cylinder #3 and the fifth cylinder #5 that correspond to an example of the "subset of one or more cylinders" of the internal combustion engine 94.

Figure 12B:
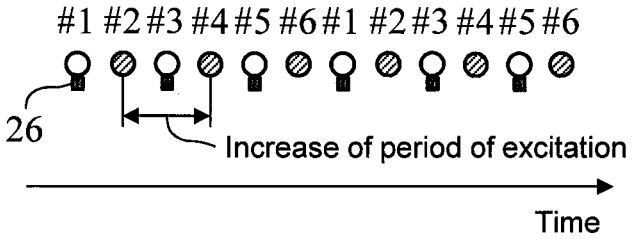

FIG. 12B represents, in association with the firing order, the presence or absence of the compression in each cylinder while all the decompression devices 26 (i.e., three decompression devices 26) of the internal combustion engine 94 are in the decompression operating state. The example shown in FIG. 12B does not also produce the compression sequentially in the cylinders that are adjacent to each other in terms of the firing order. Therefore, similarly to the first to fourth embodiments, when passing through the first power train resonance range, the resonance can be reduced as a result of an increase of the power train resonance range associated with an increase of the period of the excitation.

5-2. Another Example of Selection of Cylinders Having Decompression Device in V-Type Six-Cylinder Engine An example of the cylinders having the decompression device 26 in the V-type six-cylinder internal combustion engine 94 may be a combination of the second cylinder #2, the fourth cylinder #4 and the six cylinder #6, instead of the example described above. Also, the decompression devices 26 may alternatively be installed for any one of the following combinations of four cylinders, that is, a combination of #1, #2, #4 and #5, a combination of #2, #3, #5 and #6, and a combination of #3, #4, #6 and #1. Furthermore, another example of the cylinders (i.e., a subset of one or more cylinders) having the decompression device 26 may be any desired combination of five cylinders.

6. Six Embodiment

Figure 13A:
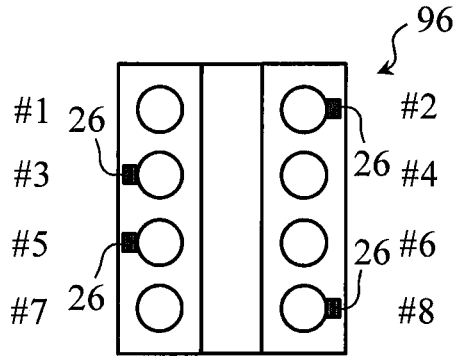
FIGS. 13A and 13B are diagrams for describing an example of selection of cylinders having the decompression device with respect to a V-type eight-cylinder internal combustion engine.

Next, a sixth embodiment according to the present disclosure will be described with reference to FIGS. 13A and 13B. A hybrid vehicle according to the present embodiment is the same as the hybrid vehicle according to the first embodiment except that a V-type eight-cylinder internal combustion engine 96 (see FIG. 13A) is included instead of the in-line four-cylinder internal combustion engine 20.

6-1. Example of Selection of Cylinders Having Decompression Device in V-Type Eight-Cylinder Engine FIGS. 13A and 13B are diagrams for describing an example of selection of the cylinders having the decompression device 26 with respect to the V-type eight-cylinder internal combustion engine 96. An example of the firing order in this internal combustion engine 94 is #1, #8, #4, #3, #6, #5, #7 and #2. In the example shown in FIG. 13A, the decompression device 26 is installed for each of the eight cylinder #8, the third cylinder #3, the fifth cylinder #5 and the second cylinder #2 that correspond to an example of the "subset of one or more cylinders" of the internal combustion engine 96.

Figure 13B:
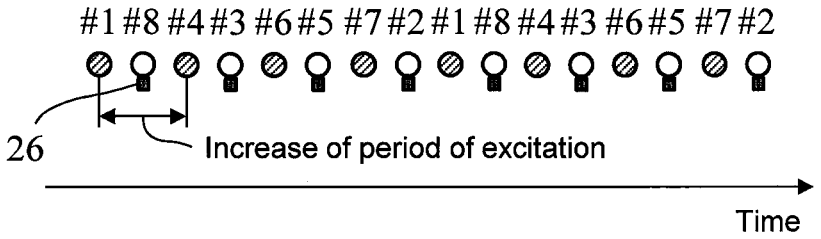

FIG. 13B represents, in association with the firing order, the presence or absence of the compression in each cylinder while all the decompression devices 26 (i.e., four decompression devices 26) of the internal combustion engine 96 are in the decompression operating state. The example shown in FIG. 13B does not also produce the compression sequentially in the cylinders that are adjacent to each other in terms of the firing order. Therefore, similarly to the first to fifth embodiments, when passing through the first power train resonance range, the resonance can be reduced as a result of an increase of the power train resonance range associated with an increase of the period of the excitation.

6-2. Another Example of Selection of Cylinders Having Decompression Device in V-Type Eight-Cylinder Engine An example of the cylinders having the decompression device 26 in the V-type eight-cylinder internal combustion engine 96 may be a combination of #1, #4, #6 and #7 that is another example in which a compression-occurrence cylinder and a non-compression-occurrence cylinder are alternately repeated, similarly to the example described above. Also, an example in which three non-compression cylinders are successive, such as, a combination of #8, #4, #3, #5, #7 and #2, a combination of #4, #3, #6, #7, #2 and #1, a combination of #3, #6, #5, #2, #1 and #8, or a combination of #6, #5, #7, #1, #8 and #4 may correspond to another example of the cylinders having the decompression device 26. Moreover, an example with unequal intervals according to the order from one compression-occurrence cylinder, two non-compression-occurrence cylinders, one compression-occurrence cylinder, two non-compression-occurrence cylinders, one compression-occurrence cylinder and one non-compression-occurrence cylinder (for example, a combination of #8, #4, #6, #5 and #2) may correspond to still another example of the cylinders having the decompression device 26. Furthermore, yet another example of the cylinders (i.e., a subset of one or more cylinders) having the decompression device 26 may be any desired seven cylinders.

7. Other Embodiments 7-1. Other Examples of Internal Combustion Engine

The number and arrangement of cylinders of the internal combustion engine according to the present disclosure are not limited to the examples of the first to sixth embodiments described above. That is to say, any desired number of cylinders of the internal combustion engine may be available as long as it is plural, and the arrangement of cylinders may not always be of the in-line type and the V-type and, for example, be of horizontally opposed type or W-type.

7-2. Another Example of Execution Timing of Control of Decompression Device

In the first and second embodiments, the examples in which the control of the decompression device 26 is performed in both the course of the engine stop and the course of the engine start-up have been described. However, the control of the decompression device according to the present disclosure may alternatively be performed in only either one of the course of the engine stop and the course of the engine start-up.

7-3. Other Examples of Drive Motor Unit and Power Train

The "drive motor unit" according to the present disclosure is not limited to the foregoing, as long as it is available to drive a vehicle and includes an electric motor that is coupled to an internal combustion engine without a clutch interposed therewith (i.e., an electric motor that is available to perform cranking of the internal combustion engine). Moreover, "an electric motor that is coupled to an internal combustion engine without a clutch interposed between the drive motor unit and the internal combustion engine" may not always serve mainly as a generator as with the generator 62 of the drive motor unit 60. That is to say, in the hybrid vehicle according to the present disclosure, an electric motor included in a drive motor unit for driving the vehicle may alternatively be used as an "electric motor" that is available to perform cranking of an internal combustion engine. As just described, "an electric motor that is coupled to an internal combustion engine without a clutch" is not always required to be used to drive a hybrid vehicle, as long as it generates an energy for driving the vehicle (i.e., a driving force for the vehicle, or an electric power for driving the vehicle). Furthermore, the "power train" of the hybrid vehicle according to the present disclosure may be, for example, be of series type using the internal combustion engine 20 only for electric power generation, instead of the type using, as its power source, both the internal combustion engine 20 and the drive motor unit 60 (i.e., torque-split type, such as the power train 10 provided with the drive motor unit 60, or parallel type).

The embodiments and modification examples described above may be combined in other ways than those explicitly described above as required and may be modified in various ways without departing from the scope of the present disclosure.

What is claimed is:

1. A hybrid vehicle, comprising a power train including an internal combustion engine equipped with a plurality of cylinders and a drive motor unit, wherein the drive motor unit includes an electric motor coupled to the internal combustion engine without a clutch interposed between the drive motor unit and the internal combustion engine, wherein the internal combustion engine includes one or more decompression devices that are each installed for a subset of one or more cylinders that are one or more but not all of the plurality of cylinders, the one or more decompression devices operating to release compression pressure in the subset of one or more cylinders in at least one of a course of an engine stop and course of an engine start-up in which combustion is not performed, and wherein the subset of one or more cylinders are selected such that, when the one or more decompression devices are operating, compression is not produced sequentially in cylinders that are adjacent to each other in terms of a firing order of the internal combustion engine.

2. The hybrid vehicle according to claim 1, further comprising a control device, wherein, in stopping an operation of the one or more decompression devices in the course of the engine start-up, the control device is configured, when an engine speed is higher than an upper limit value of a first power train resonance range and is lower than a lower limit value of a second power train resonance range located on a higher engine speed side relative to the first power train resonance range, to stop the operation of the one or more decompression devices, wherein the first power train resonance range is an engine speed range that centers on an engine speed value at which a period of excitation due to compression in the internal combustion engine coincides with a natural vibration period of the motor drive unit when the operation of the one or more decompression devices is stopped, and wherein the second power train resonance range is an engine speed range that centers on an engine speed value at which the period of the excitation coincides with the natural vibration period of the drive motor unit when the one or more decompression device are operating.

3. The hybrid vehicle according to claim 1, further comprising a control device, wherein, in operating the one or more decompression devices in the course of the engine stop, the control device is configured, when an engine speed is higher than an upper limit value of a first power train resonance range and is lower than a lower limit value of a second power train resonance range located on a higher engine speed side relative to the first power train resonance range, to operate the one or more decompression devices, wherein the first power train resonance range is an engine speed range that centers on an engine speed value at which a period of excitation due to compression in the internal combustion engine coincides with a natural vibration period of the motor drive unit when an operation of the one or more decompression devices is stopped, and wherein the second power train resonance range is an engine speed range that centers on an engine speed value at which the period of the excitation coincides with the natural vibration period of the drive motor unit when the one or more decompression device are operating.

* * * * *